United States Patent [19]

Teoh et al.

[11] Patent Number: 4,691,547

[45] Date of Patent: Sep. 8, 1987

[54] ROLLING MILL STRIP THICKNESS CONTROLLER

[75] Inventors: Eam K. Teoh; Graham C. Goodwin, both of Newcastle; William J. Edwards, Carey Bay, all of Australia

[73] Assignee: John Lysaght (Australia) Limited, Sydney, Australia

[21] Appl. No.: 722,161

[22] PCT Filed: Sep. 7, 1984

[86] PCT No.: PCT/AU84/00172

§ 371 Date: Apr. 11, 1985

§ 102(e) Date: Apr. 11, 1985

[87] PCT Pub. No.: WO85/00998

PCT Pub. Date: Mar. 14, 1985

[30] Foreign Application Priority Data

Sep. 8, 1983 [AU] Australia ..... PG1318

[51] Int. Cl.[4] ..... B21B 37/12

[52] U.S. Cl. ..... 72/16; 72/8; 72/11

[58] Field of Search ..... 72/8, 11, 16, 10, 19, 72/20

[56] References Cited

U.S. PATENT DOCUMENTS 3,543,549 12/1970 Howard ..... 72/8

4,126,027 11/1978 Smith, Jr. et al. ..... 72/11

4,222,254 9/1980 King, Jr. et al. ..... 72/8

4,545,228 10/1985 Yamaguti et al. ..... 72/16

FOREIGN PATENT DOCUMENTS 1425826 2/1972 United Kingdom .

1580066 9/1977 United Kingdom .

908455 6/1980 U.S.S.R. .

818691 4/1981 U.S.S.R. ..... 72/16

*Primary Examiner*—Robert L. Spruill

*Assistant Examiner*—Steve Katz

*Attorney, Agent, or Firm*—Barnes & Thornburg

[57] ABSTRACT

A method for automatically controlling the thickness of product emerging from a rolling mill. Signals indicative of total roll force (F), rollgap position (S), angular position of one mill roll (v) and downstream product thickness (h) are utilized to obtain an output signal indicative of roll eccentricity affecting the true instantaneous rollgap position as a function of the measured mill roll angular position. The output signal may be use to compensate an estimate of instantaneous thickness of the product for the purpose of controlling the gap between work rolls. If preferred the output signal may be further processed to obtain an output signal indicative of the periodic roll eccentricity of a set of rolls having a common period of rotation or of a plurality of such sets.

18 Claims, 9 Drawing Figures

ROLLING MILL STRIP THICKNESS CONTROLLER

TECHNICAL FIELD

This invention relates to a method of, and apparatus for, control of a rolling mill and more particularly to control of thickness on hot and cold metal rolling mills.

BACKGROUND ART

A common configuration of rolling mill has four or more rolls mounted in a vertical plane with two smaller diameter work rolls supported between larger diameter back-up rolls. Such mills may operate in isolation or in tandem with other similar mill stands.

A particular problem of importance in mill control arises from out-of roundness in one or more of the rolls which produces cyclic variations in the gap between the rolls. These variations in gap cause corresponding changes in roll separating force, metal velocities and, most importantly, in the thickness of the product issuing from between the rolls.

Control of output product thickness is usually effected by changing the relative gap between the work rolls by means of a motor driven screw or hydraulic cylinder acting on the back-up roll bearings. Usually the bearing position is measured with respect to the support frame (the so-called "rollgap position"). The separation of the work rolls cannot be directly measured by the roll gap position because of significant elastic deformations in the mill stand components.

It is conventional practice to provide a rolling mill stand with a transducer for measuring the total deformation force applied to the workpiece and another for measuring the roll gap position.

Furthermore, it is often desirable to install a thickness measuring gauge after the stand to monitor the operation of the process and the effectiveness of any thickness control system which may be installed.

It is well known to those skilled in this art that the dynamic response of a feedback control system is deleteriously affected if a time delay occurs between the creation of a change and measurement of the change and for this reason techniques have been developed for estimating the rolled strip thickness from a knowledge of the nominal gap between the rolls and the change in this gap due to elastic deformations which are calculated as a function of measured force and nominal material width. This "instantaneous" estimate of product thickness can be used for feedback control to the stand on which measurements were obtained or for feedforward control to downstream stands. Major benefits are gained by use of this technique if the rollgap adjusting mechanism has a response time which is significantly less than the time delay to the measured thickness obtained downstream.

A major drawback of the feedback and feedforward control techniques described above is that if the mill work rolls and backup rolls are not perfectly round, the measured rollgap position is not equal to the true roll gap position, and eccentricity induced signal components appear in the force and thickness measurements. These lead to an incorrect "estimated thickness" which results in the control systems correcting non-existent errors, thereby creating worse product thickness deviations than are likely to arise with no control.

Numerous techniques have been proposed for overcoming this problem including tuned filters, adjustable deadbands, the addition of force control systems and direct measurement of the eccentricity effects as the rolls rotate with subsequent subtraction to cancel their effect. The latter technique has been shown to have some beneficial results but suffers from the need to install eccentricity measuring equipment on the rolls producing the eccentricity component in the transducer signals.

Normally the back-up rolls are the major source of the eccentricity signal components although the work rolls or other, intermediate rolls, may also contribute.

It is an object of the present invention to provide a simple and effective method for eliminating the effect of multiple, superimposed cyclic variations caused by the individual roll eccentricity signals. The method proposed is capable of operation without direct measurement of the angular position of all the rolls. However, if such information is available, it may be used in the proposed method to obtain further benefits. Accurate, angular speed or position information is readily available for the driven rolls, usually the work rolls in a four-high configuration. The angular position measurement is preferred to an integrated speed measurement because of its inherently greater accuracy. These signals and a knowledge of all the roll diameters is sufficient to implement the proposed method of roll eccentricity control.

DISCLOSURE OF THE INVENTION

According to one aspect, the invention consists of a method for automatically controlling the thickness of product emerging from a rolling stand comprising the steps of producing a first input signal indicative of total roll force, producing a second input signal indicative of rollgap position, producing a third input signal indicative of the angular position of a first mill roll, producing a fourth input signal indicative of product thickness at a predetermined downstream location relative to the rollgap and deriving from said first, second, third and fourth input signals a first output signal indicative of the total roll eccentricity affecting the true instantaneous rollgap position as a function of the first mill roll angular position. This signal varies with time as the rolls rotate and the relative phase and amplitude of the various roll eccentricity components alters.

In preferred embodiments of the invention, the first output signal is filtered by means employing an algorithm which requires an accurate knowledge of the period of each significant component which contributes to the roll eccentricity signal and produces a second output signal representing the predicted composite roll eccentricity at the rollgap.

A further recommended step is to estimate the instantaneous product thickness from the first signal (F) and the second signal (S) and to modify this thickness estimate by the second output signal, thereby compensating for the effect of roll eccentricity and producing an eccentricity compensated, instantaneous thickness estimate. This latter signal is then used as the input signal to a feedback thickness controller which adjusts the gap between the work rolls.

If the individual roll periods cannot be estimated directly from angular position measurements or indirectly from roll diameter or speed ratios and other roll angular position measurements, then adaptive techniques should be invoked to estimate the fundamental signal period for each roll which is considered to be capable of producing eccentricity related thickness errors.

Further improvement in performance may be achieved by adding a suitably synchronised proportion of the second output signal to the output of the feedback thickness controller. This technique is not particularly demanding to implement and enables the true actuator response to be fully utilised for thickness control. For preference the control design incorporates other features which explicitly compensate for the influence of product dimensions, material properties, bearing characteristics, dependence of the time delays in the process upon rolling speed and variations in stand deformation behaviour.

According to a second aspect the invention consists in:

apparatus for controlling the thickness of material produced by a rolling mill stand comprising;

means for producing a first input signal indicative of the roll force (F);

means for producing a second input signal indicative of rollgap position (S);

means for producing a third input signal indicative of roll angular position (v);

means for producing a fourth input signal indicative of product thickness at a predetermined downstream position relative to the rollgap (h);

means for deriving from the first, second, third and fourth input signals a first output signal indicative of total roll eccentricities;

means for filtering the first output signal to minimise the influence of noise and produce a second output signal representing the predicted, composite roll eccentricity at the roll gap for all rolls whose periods are specified by angular position or speed measurements or roll diameter information;

means for deriving from the first input and second input signal a third output signal indicative of instantaneous product thickness at the rollgap, and means for utilising the second output and third output signals to adjust the rollgap position whereby to control product thickness independently of roll eccentricity disturbances.

If desired, a deadzone may be introduced to reduce the effect of any unfiltered error components in the instantaneous thickness estimate.

An advantage of a preferred embodiment is its ability to compensate for any hysteresis which may arise due to sliding friction between moving parts of the stand components or hydraulic cylinders and pistons.

The method of the invention is made possible by the development of a new eccentricity estimation and filtering algorithm which may be implemented in a digital computer and applied to one or more stands in a rolling mill train.

BRIEF DESCRIPTION OF THE DRAWINGS

By way of example an embodiment of the invention is described hereinafter with reference to the accompanying drawings wherein.

BEST MODE OF PERFORMANCE

Figure 1:
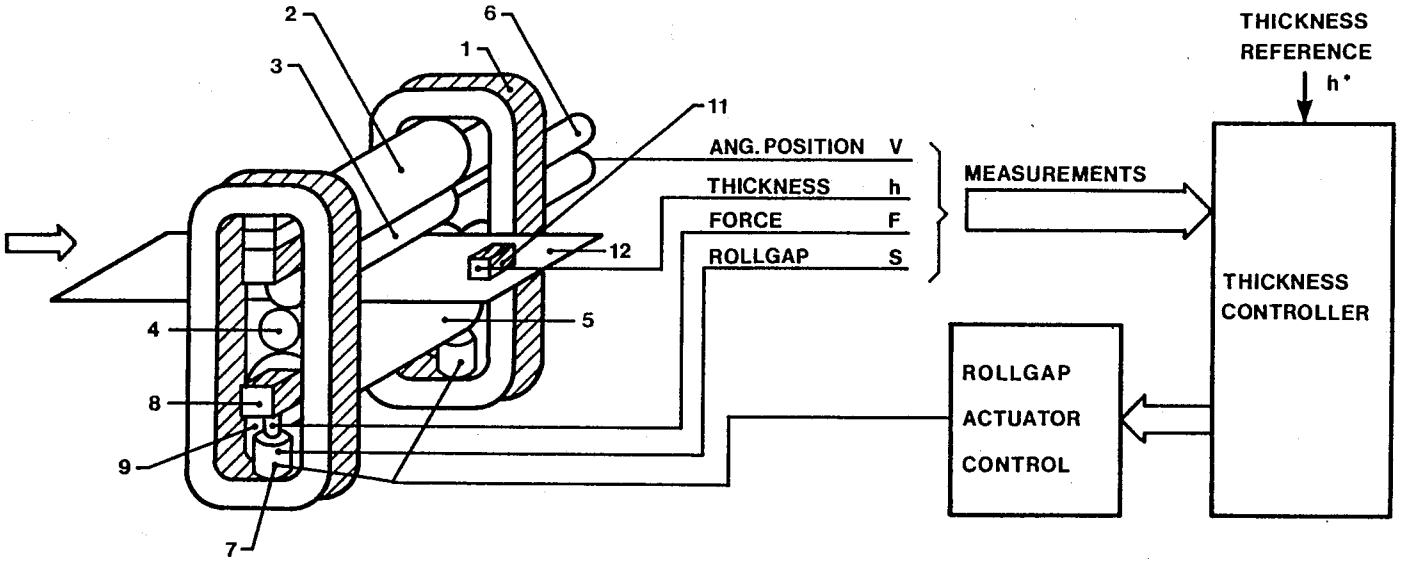
PRIOR ART FIG. 1
FIG. 1 shows schematically a conventional rolling mill stand and control system.

With reference to FIG. 1 there is shown schematically a conventional mill stand having a frame 1, upper back up roll 2, upper work roll 3, lower work roll 4 and lower backup roll 5. The mill is driven by motors 6.

Rollgap position controls hydraulic cylinders 7 which act on bearings 8 of backup roll 5.

The mill is provided with a force transducer 9 producing a signal indicative of total roll force F′ and a roll gap transducer producing a roll gap position signal S.

One or more roll angular position signals v are available from transducers associated with the drive system. Roll angular position signals ($v_2$–$v_4$) may optionally be available for other rolls as well. Gauge 11 measures the thickness of strip 12 downstream of the work rolls and produces a thickness signal h′. Signals v, h′, F′ and S are fed to a thickness controller, together with a reference thickness signal h*. A roll gap actuator control signal is output by the thickness controller and adjusts hydraulic cylinders 7 which act on backup roll bearings 8 to control the gap between the work rolls.

Figure 2:
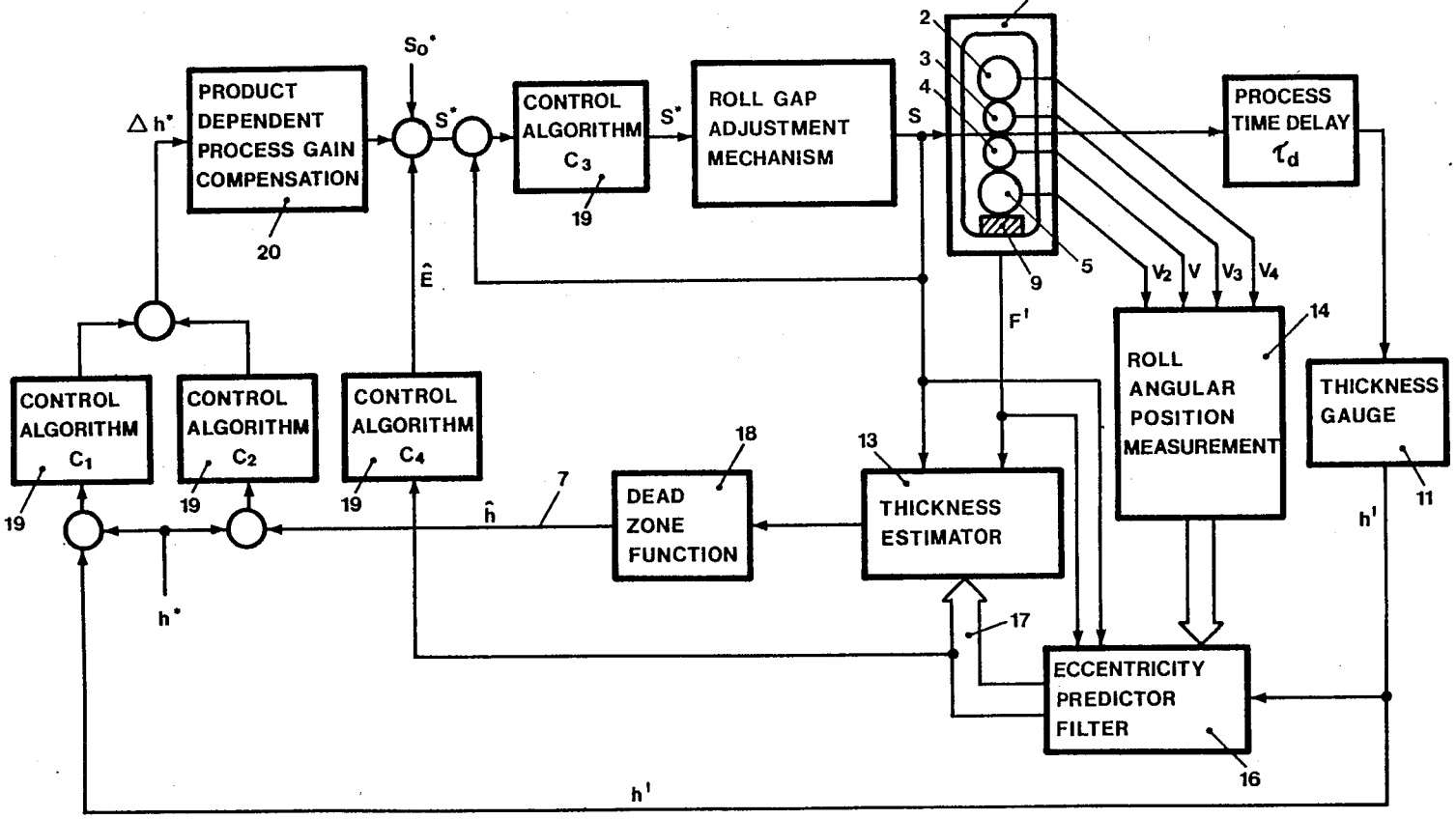
FIG. 2 shows schematically an embodiment of a rolling mill control system according to the invention.

An embodiment according to the invention is shown schematically in FIG. 2. The same numerals and letters are used in FIG. 2 to identify parts and signals as were used in FIG. 1 to identify corresponding parts and signals.

In FIG. 2, $C_1$ to $C_4$ represent conventional control algorithms. It will be understood that in general signals may be processed via an algorithm by means of digital or analogue computing apparatus per se known in the art.

The mill stand of FIG. 2 provides signals F′ (measured force), S (rollgap position), v (roll speed tachometer or position detector) and h′ (downstream thickness) from suitable transducers or measuring instruments.

The measurements are processed via a thickness estimator algorithm 13 and an eccentricity predictor incorporating a smoothing filter 16. Sets of position synchronised measurements are analysed and the periodic component obtained by a specified mathematical substitution.

The eccentricity predictor 16 produces a roll eccentricity estimate signal 17 which is used by the thickness estimator 13 to produce a compensated thickness estimate signal h. This signal h and the measured thickness signal h′ are used in a conventional manner for feedback control. A further element is added via a feedforward controller $C_4$ which uses the roll eccentricity estimate signal to make rollgap position adjustments before an error is detectable.

A deadzone 18 may optionally be inserted to operate on the thickness signal $\hat{h}$ to filter out noise or other undesirable components which have not been eliminated by the thickness estimator.

A variety of controll configurations of varying complexity may be generated. Most simply this can be done by redefining the four different control algorithms $C_1$ to $C_4$ of FIG. 2.

Another feasible configuration could be generated by deleting the rollgap position feedback signal to the rollgap position controller and changing the settings of controllers $C_1$ to $C_4$ and the process gain compensation function.

By way of further explanation, the strip exit thickness h, is given by:

$$h=S(F,W)+(S-S_0)+e \tag{1}$$

where S(F,W) is the elastic deformation of the stand components, W is the strip width, S is the rollgap (or screw) position with respect to an arbitrary datum, $S_o$ is a constant and e is the effective total eccentricity signal for the complete set of rolls in the mill. $S_o$ is normally a constant however, on mills with oil film bearings, it includes the effective rollgap position change induced by the backup-roll bearing (a function of load and angular speed).

During rolling, the variations in roll force are typically less than 15 percent of the average value and a linear model F/M, (for the non-linear function S(F,W) may be assumed and equation (1), in linearised form becomes:

$$\Delta F=M(\Delta h-e-\Delta S) \tag{2}$$

where the mill modulus M is defined as $$-\left\{\frac{\partial S}{\delta F}(F,W)\right\}^{-1}.$$

The roll force F must also satisfy the nonlinear plastic deformation equation if inertial effects are negligible, that is:

$$F=W\,P$$

where the specific roll force P is a function of h, rolling parameters and strip disturbances. The linear form of this equation is:

$$\Delta F=\frac{\partial F}{\partial h}\Delta h+F_d \tag{3}$$

where $F_d$ is a force change due to external disturbances other than roll eccentricity.

Since the elastic and plastic deformation forces are always in equilibrium, solving equations (2) and (3) and eliminating ΔF gives:

$$\Delta S=(1+a)\Delta h-F_d/M-e \tag{4}$$

where $$a=-\frac{\partial F}{\partial h}/M.$$

This equation defines the control change required to achieve a specified thickness correction or to compensate for a known force disturbance.

Because of friction between the roll-neck bearings and the mill frame, and also in the cylinders of a hydraulic actuation mill, the measured roll force F′ may not be equal to the roll force F exerted on the strip by the work-rolls. Although the friction force may be less than 2 percent of the average roll force, it can lead to significant errors in the estimated thickness deviations. Assuming that the friction force is proportional to the applied force and has its direction determined by the direction of the rollgap actuator, (i.e. Sign ($\dot{S}$)), we may write an equation for the total friction force $F_f$ as:

$$F_f\mu_f F'\,\mathrm{Sign}(\dot{S}) \tag{5}$$

where $\mu_f$ is a constant friction factor and S is assumed to be positive when the rollgap is opening. That is, the rolling force F is related to the measured force F′ by the equation:

$$F=F'-F_f=[1-\mu_f\mathrm{Sign}(\dot{S})]F' \tag{6}$$

where the measured force is derived from a load cell placed between the hydraulic cylinder and the frame. Similar equations may be derived for other configurations of measurement and hysteresis models.

The estimate for the combined eccentricity and steady state offset $\hat{e}_o$ is obtained by substituting the above expression for roll force F in equation (1), that is:

$$(\hat{e}+\hat{e}_0)=h-(S-S_0)-S(F,W). \tag{7}$$

Finally, to complete the process model formulation, a dynamic model for the open-loop actuator response S, as a function of the input velocity reference signal S* is required. This may be written as:

$$S=\dot{S}^*/s(1+s\tau_a),\ |\dot{S}|\leqq\dot{S}_{max} \tag{8}$$

where s denotes the Laplace transform variable. This means that the closed loop, actuator position response will have the characteristics of a second order system.

It may be assumed that mill modulus M, strip width W, the hysteresis force coefficient $\mu_f$, and the time delay to the thickness gauge $\tau_d$ are known.

A known key concept in the control strategy is to use equation (7) to estimate the eccentricity and offset signal $(\hat{e}+\hat{e}_o)$ directly from process measurements, with the instantaneous thickness replaced by the downstream thickness h′ which corresponds to the exit thickness rolled at a time $\tau_d$ earlier where $\tau_d$ is the transport delay between the rollgap and the thickness gauge. The time delay may be determined from a knowledge of the work roll speed or angular position and the nominal forward slip ratio which is defined as the product exit speed divided by the work roll surface speed. The forward slip ratio may be calculated from well-known equations as a function of product dimensions and properties and nominal processing conditions. Thus, past values of S and F′ must be stored so that $(e+e_0)$ at time $(t-\tau_d)$ can be estimated as $$(\hat{e}+\hat{e}_0)_{t-\tau_d}=h'_t+S(F_{t-\tau_d},W)-(S_{t-\tau_d}-S_0) \tag{9}$$

If the eccentricity signal has period $\tau$, then we can estimate the current value of $(e+e_o)_t$ as:

$$(\hat{e}+\hat{e}_0)_t=(\hat{e}+\hat{e}_0)_{t-\tau} \tag{10}$$

Finally, we can again use equation (7) to give an instantaneous estimate of the strip exit thickness as:

$$\hat{h}_t = S(F_t, W) + (S_t - S_0) + (\hat{e} + \hat{e}_0)_t \quad (11)$$

where $(\hat{e}+\hat{e}_o)$ is obtained from (9) and (10).

Equations (9) to (11) will be referred to as the "eccentricity compensated" thickness estimator and desirably include additional compensation terms for hysteresis and eccentricity. If the response time of the thickness gauge is appreciable, then appropriate filters can be introduced to compensate measured force and rollgap position.

Figure 3:
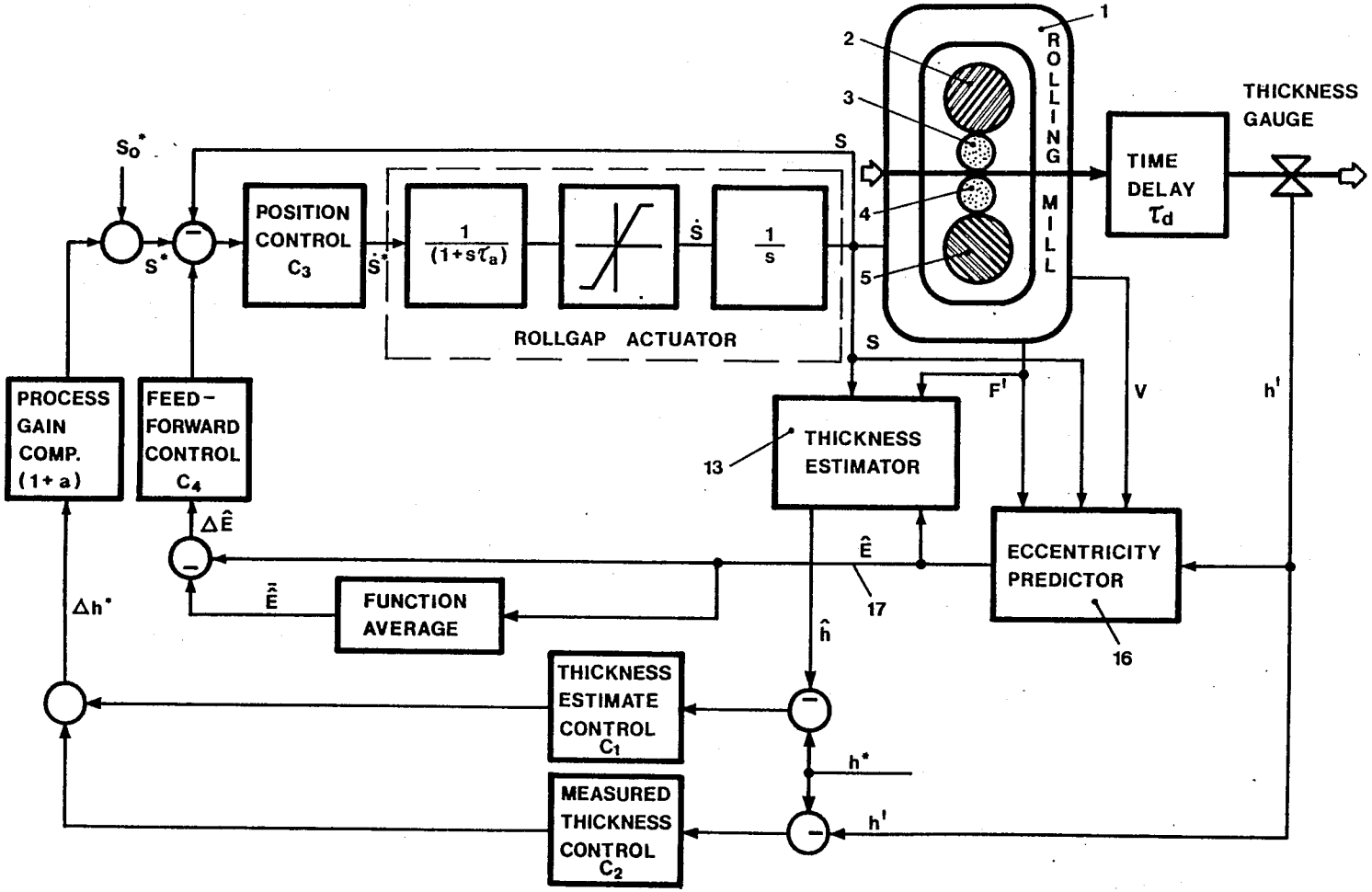
FIG. 3 shows schematically a particular form of Control System structure tested by computer simulation.

Numerous combinations of loop design could be considered to exploit the availability of the thickness estimate $\hat{h}$. Even the simplest system, consisting of a single loop controller with an input of $\hat{h}$ and an output to the actuator speed reference $\dot{S}^*$ gave excellent results. Further improvement was achieved with three separate feedback loops for actuator position control, fast thickness estimate $\hat{h}$ control, and slower acting integral control of the measured thickness h'. (See FIG. 3.)

Combining the outputs of the two outer loops yields a signal $\Delta h^*$, which represents the desired change in strip thickness:

$$\Delta h^* = k_1(h^* - \hat{h}) + k_2 \int (h^* - h')dt \quad (12)$$

where $k_1$, and $k_2$ are tuning constants and $h^*$ is the reference thickness. This is converted to a rollgap position change by multiplying by the factor $(1+a)$ derived in equation (4). This calculation is implemented by box 20. To this a further predictive term $[(\hat{e}+\hat{e}_0)-(\overline{\hat{e}-\hat{e}_0})]$ may be added to give a rollgap position reference $S^*$ which takes account of future eccentricity signals and their effect on the gap between the work-rolls. Therefore the control equation for $S^*$ becomes:

$$S^* = \frac{(1+a)}{}[k_1(h^* - \hat{h}) + k_2 \int (h^* - h')dt] + [(\hat{e}+\hat{e}_0) - (\overline{\hat{e}+\hat{e}_0})] + S^*_0 \quad (13)$$

where $S^*_o$ is the initial rollgap position when control is initiated at the beginning of a coil. That is, referring to FIG. 3, $$C_1 = \frac{k_1}{s\tau_f + 1}, \; C_2 = \frac{k_2}{s(s\tau_f + 1)}, \; C_3 = k_3 \text{ and } C_4 = 1 \quad (14)$$

Compensation for actuator non-linearity may be necessary to prevent overshoot in response to large amplitude disturbances. This is due to integrator operation when the actuator speed is constrained to its maximum value. Alternatively, different controller algorithms $C_i$ may be introduced.

The controller gain $k_2$ is mill speed dependent and should be varied as a non-linear function of the ratio $(\tau_a/\tau_d)$. This function is best determined by simulation, however, if the actuator response is sufficiently fast, such that $\tau_a/\tau_d$ is always less than 0.3, then $k_2$ may be represented by a linear function of speed.

The previous sections have described the prediction of the eccentricity signal in a purely deterministic. environment and when there is only one fundamental roll period in the eccentricity signal. In practice, all measurements will be corrupted by noise and therefore we are concerned with the prediction of a periodic signal from noisy measurements. It has been shown that a suitable prediction for the filtered estimate $\hat{E}_t$ may have the form:

$$\hat{E}_t = \alpha \hat{E}_{t-\tau} + (1-\alpha)(\hat{e}+\hat{e}_0)_t, \; 0 \leqq \alpha \leqq 1 \quad (15)$$

Inspection of equation (15) shows that past data is given an exponential weighting in forming the predicted estimate. The parameter $\alpha$ affects the memory of the filter such that if $\alpha$ is near 1 then the filter will have a long memory, good noise discrimination and a slow response to dynamic changes in the eccentricity waveform. Conversely, if $\alpha$ is near 0 the filter will have a short memory with poor noise discrimination but rapid adaptability. Thus the choice of $\alpha$ is a compromise between speed of response and noise immunity. A fixed value of $\alpha$ was found to be adequate for the the majority of rolling mill applications. If necessary, it could be varied in response to a suitable signal characteristic.

When there are multiple eccentric rolls with different periods a separate eccentricity estimator $\hat{E}$, similar to that described previously, must be introduced for each of the m sets of rolls having distinct periods.

The algorithms for each of the filters may be processed in any order. The input signal to each filter should preferably be calculated from the eccentricity signal, as determined by equation 7, minus the cumulative sum of the previously processed filters. That is, for filter number i, the input is:

$$(\hat{e}_i + \hat{e}_{oi}) = (\hat{e} + \hat{e}_o) - \sum_{j=1}^{m-1} (\hat{E}_j), \; i = 1,m \quad (16)$$

When forming the estimate $\hat{E}_t$, of the correct value of the composite eccentricity signal for all rolls, the individual outputs of each filter must be combined with appropriate synchronisation. That is, $$\hat{E}_t = \sum_{j=1}^{m} \hat{E}_{j,t-tj} \quad (17)$$

Figure 5:
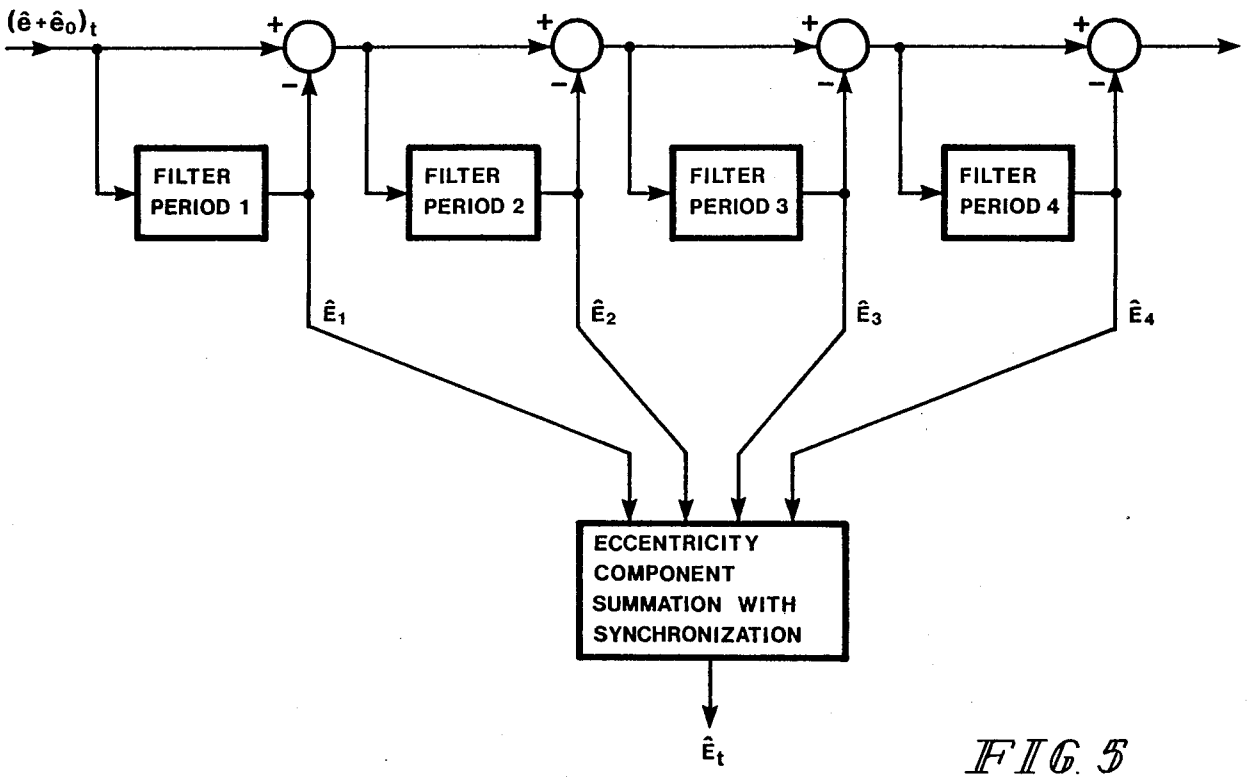
FIG. 5 shows a filtering arrangement for multiple eccentric rolls with four different periods.

This is shown diagrammatically in FIG. 5 for the case of four different period rolls.

The availability of an accurate, measured thickness reading for the estimation of the eccentricity signal ensures that errors in the elastic deformation and hysteresis models are corrected by internal feedback within the estimation algorithms. That is, in the "steady state", the estimated thickness h is equal to the measured thickness h' at all sample points on the eccentricity function. This leads to a remarkable robustness property which reduces the dependence of the eccentricity compensation performance upon assumed nominal model parameters. Of course, the accuracy of the elastic deformation model does influences the disturbance attenuation properties of the $\hat{h}$ control loop. The steady state error attenuation factor $\beta$ of this loop in isolation may be shown to be a function of the controller gain $k_1$ and the mill modulus estimate, $\hat{M}$:

$$\beta = \frac{1 + k_1(1 + a\epsilon)}{1 + k_1\epsilon(1 + a)} \quad (16)$$

where $\epsilon = (1 - M/\hat{M})$

Simulation results, presented hereinafter, confirmed that, if the various control loops which contain product dependent gains are compensated using equation (13), then it is feasible to maintain a fast, consistent response over a wide range of rolled products.

The previous section discussed the steady state sensitivity of the control law to model errors. Clearly, the transient performance depends upon all parameters in the model, especially M, a, $\tau$, and $\tau_d$. The parameter M is a property of the mill and strip width and can reasonably be assumed to be known within 10%. The time delay $\tau_d$ can be accurately calculated from the instantaneous work-roll velocity measurements and the distance from the stand to the thickness measuring gauge. A good initial estimate for $\tau$ can be obtained in a similar way by using the nominal diameter of the backup-rolls and forward slip ratio. However, this can be refined, if desired, by substituting $\tau$ for $\tau$ where $\tau$ is defined as:

$$\hat{\tau} = \text{arg. min} \sum_{j=t-\tau_0}^{t} (\hat{E}_t - \hat{E}_{t-\tau})^2, \tau_0 \geqq \tau \tag{17}$$

The appropriate value for $\tau_0$ and the frequency of updating $\hat{\tau}$ will depend on the particular application in a similar mannner to $\alpha$. Updating of $\hat{\tau}$ should be avoided if the eccentricity signal is small or the mill speed is varying.

Finally, the parameter a can vary from coil to coil depending on rolling conditions and the material grade. The simulation tests indicated a high degree of insensitivity to this parameter, however, if desired, it can be determined from an adaptive model during the rolling of each coil.

Figure 4:
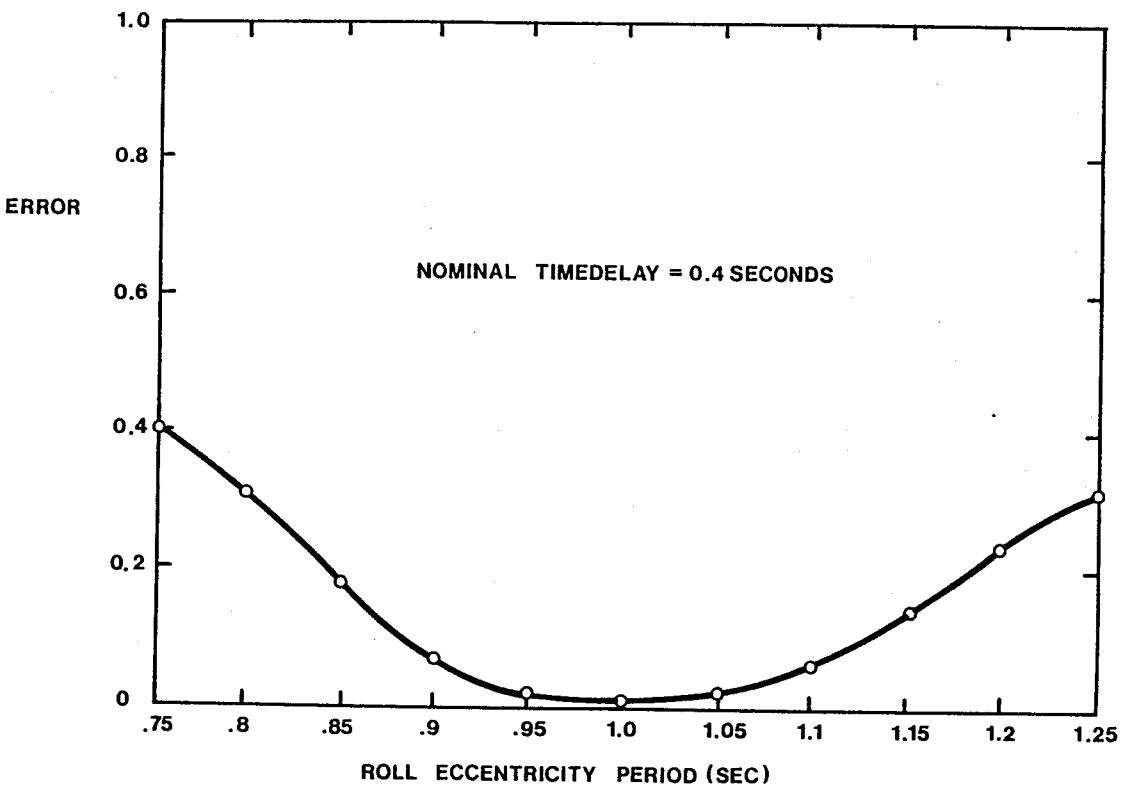
FIG. 4 shows an Example of an eccentricity period estimation algorithm for a case where the true period was 1.0 s.

FIG. 4 illustrates the estimation of the period under noisy conditions. Results such as these suggested that the estimated period should be estimated with an accuracy of better than 2%, provided that a sufficient number of samples is obtained during each roll revolution.

An extensive simulation evaluation of the new design performance has been completed whose aim was to observe the controller performance under ideal and non-ideal conditions. In the ideal case, when all relevant parameters are assumed known, the effect of roll-eccentricity on the strip exit thickness can be eliminated, provided that the eccentricity disturbances is within the capability of the rollgap positioning system. In the non-ideal case, when parameters are not equal to their true values, it has been found that the design exhibited a high degree of robustness.

Figure 6:
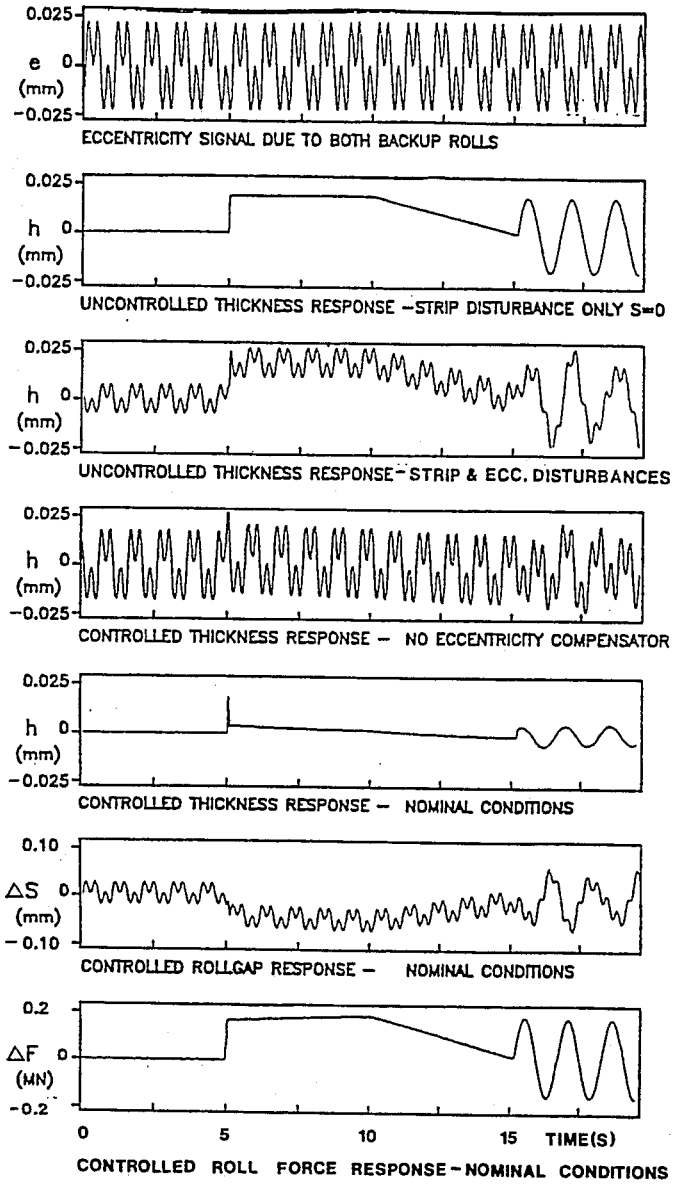
FIG. 6 shows computer simulation results for nominal rolling conditions for the case of one periodic eccentricity.
Figure 7:
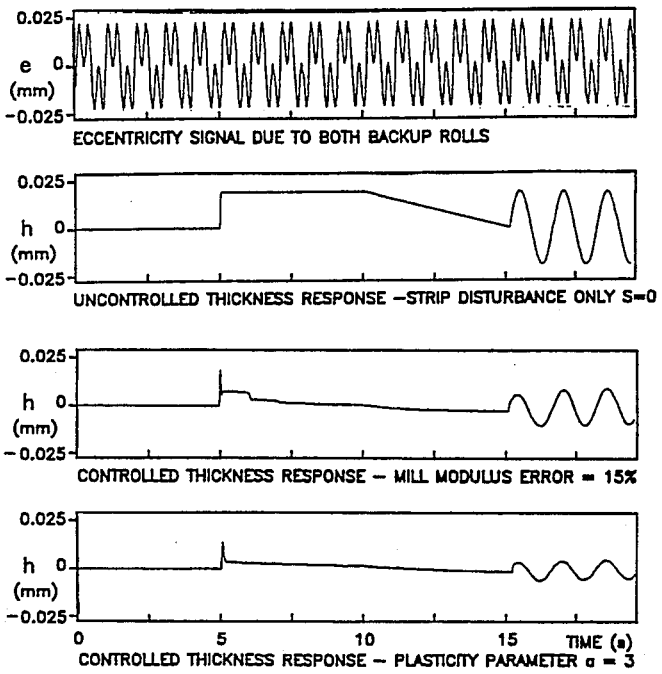
FIG. 7 shows results corresponding to the previous figure when errors exist in the mill modulus and plasticity parameters.

A range of simulated responses are provided in FIGS. 6 and 7 to illustrate typical behaviour and the robustness of the control system to parameter variations for a fast rollgap actuator capable of responding to a 0.1 mm rollgap change in 0.06 s. Signals are identified in FIG. 3. Key simulation parameters were:

| | |
|---|---|
| *mill modulus: | 3.5 MN/mm |
| *strip width: | 1000 mm |
| *plasticity constant: | 2.0 |
| *time delay: | 0.4 s |
| *control gains: | $k_1 = {}^4$, $k_2 = 1.0\ s^{-1}$, $\tau_f = 0.25$ s |

FIG. 6, presents typical simulation results for a composite input thickness disturbance consisting of a step followed by a negative ramp change and then a harmonic signal with a period 1.5 times the stand 1 backup-roll period. The periodic backup-roll eccentricity signal is comprised of a first and third harmonic each of 0.04 mm peak to peak amplitude. For the nominal conditions shown above the attenuation factor $\beta$ is equal to 5.0 and this may be discerned from the step response components of the simulated thickness behaviour. The effectiveness of the eccentricity compensator is evident from a comparison of the response with and without the eccentricity compensator.

FIG. 7 shows results corresponding to FIG. 6 for the case where parameter values are not equal to their nominal values. Specific results are provided for the case of a mill modulus error of 15% and a plasticity parameter of 3.0 (nominal value was 2.0).

Figure 8:
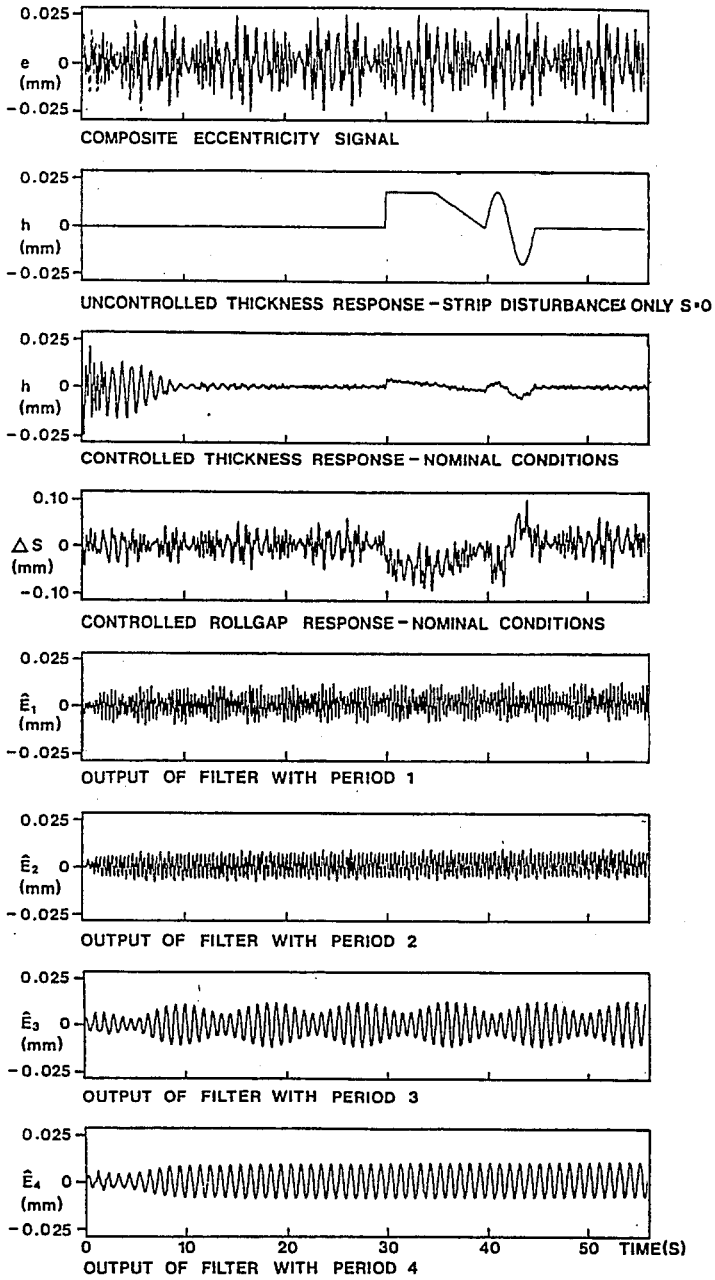
FIG. 8 shows controller simulation results for the case of four different roll diameters in a four-high mill, each containing a similar eccentricity amplitude.

FIG. 8 shows controller simulation results for the case of four different roll diameters in a four-high mill, each roll containing a similar eccentricity amplitude.

Figure 9:
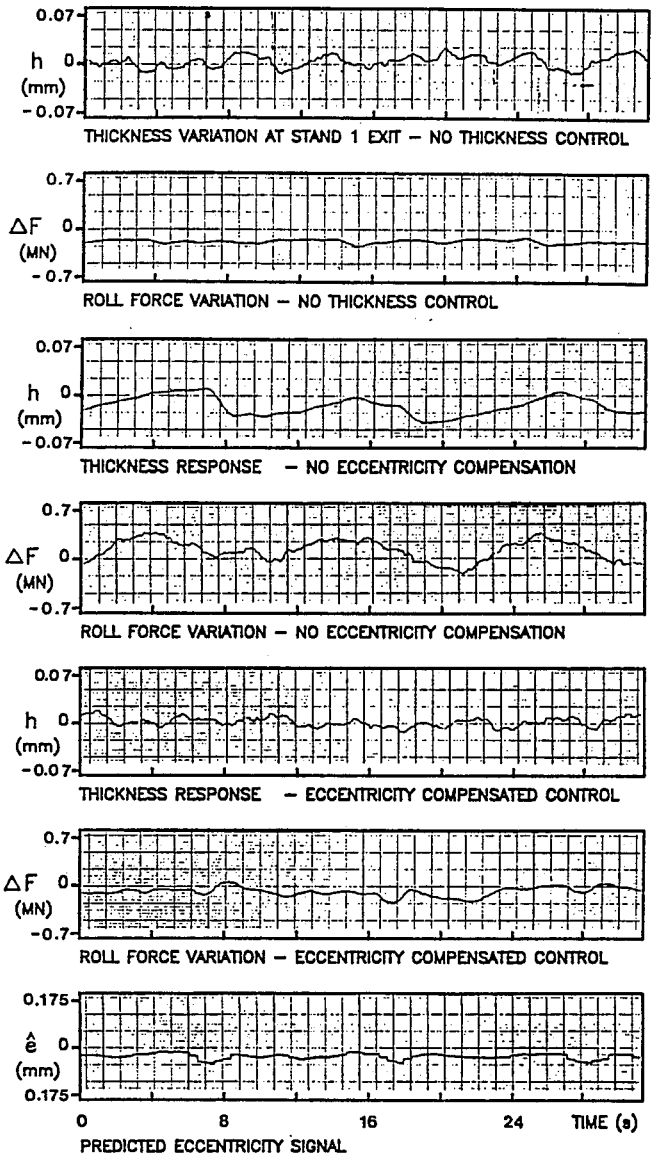
FIG. 9 shows results of application of an embodiment of the invention to a tandem mill.

Results have been obtained from the implementation of the recommended control system on a tandem cold mill having an electro-hydraulic position control system which is comparatively slow by modern standards. (Step response time for a 0.1 mm change in rollgap position is 0.5 s.) The slow positioning system precludes effective dynamic cancellation of the eccentricity disturbance when the mill is rolling at full speed. However, at a reduced speed, improved performance resulted from the combined operation of the eccentricity compensator and gaugemeter controller as is evident in FIG. 9.

As will be evident to those skilled in the art, the invention herein described may be adapted to different configurations of mill and to employ control algorithms other than herein exemplified and such modified embodiments are deemed to be within the scope hereof.

We claim:

1. A method for automatically controlling the thickness of product emerging from a rolling stand comprising the steps of producing a first input signal indicative of total roll force, producing a second input signal indicative of rollgap position, producing a third input signal indicative of the angular position of a first mill roll, producing a fourth input signal indicative of product thickness at a predetermined downstream location relative to the rollgap, and deriving from said first, second, third and fourth input signals a first output signal indicative of the total roll eccentricity affecting the true instantaneous rollgap position as a function of the first mill roll angular position.

2. A method according to claim 1 wherein the rolling stand has a set of rolls with a common period of rotation which is directly related to the period of the first mill roll and comprising the step of filtering the first output so as to produce a second output indicative of the periodic roll eccentricity of the set of rolls.

3. A method according to claim 2 wherein the rolling stand comprises a plurality of sets of rolls, each set comprising rolls sharing a common period, said method comprising the steps of producing a plurality of third input signals each indicative of roll angular position of one roll of a set, using each third signal of said plurality to filter the first output signal to produce a plurality of filtered output signals, and combining each filter output signal with the second output signal to produce a plurality of output signals each representing the periodic roll eccentricity of one of said plurality of sets.

4. A method according to claim 1 wherein an input signal indicative of angular position of a roll is obtained by the step of integrating a signal indicative of roll angular speed.

5. A method according to claim 1 further comprising the steps of filtering the first output signal to produce an output signal indicative of the period of rotation of a set of rolls sharing a common period.

6. A method according to claim 3 and further comprising the step of adding together with appropriate synchronization the output signals representing the periodic roll eccentricities of said plurality of sets of rolls to produce a third output signal representing the predicted value of composite roll eccentricity at the roll gap corresponding to multiple sets of rolls having distinct periods.

7. A method according to claim 1 further comprising the steps of combining the first and second input signals to produce a fourth output signal representing an estimate of the instantaneous thickness of product emerging from the rollgap, and producing a fifth output signal by compensating the fourth output signal for the roll eccentricity of one set of rolls indicated by the second output signal.

8. A method according to claim 7 in which the fifth output signal is produced by compensating the fourth output signal with the roll eccentricity for multiple sets of rolls as indicated by the third output signal.

9. A method according to claim 8 further comprising the steps of controlling the gap between the work rolls in accordance with the fifth output signal.

10. A method according to claim 9 further including the step of compensating the first output signal for the effect of friction induced hysteresis between the rolling mill stand components.

11. A method according to claim 6 further including the step of controlling the gap between the work rolls in accordance with the third output signal representing the predicted composite roll eccentricity signal.

12. Apparatus for controlling the thickness of material produced by a rolling mill stand comprising means for producing a first input signal indicative of roll force (F′), means for producing a second input signal indicative of rollgap position (S), means for producing a third input signal indicative of roll angular position, means for producing a fourth input signal indicative of product thickness at a predetermined position downstream relative to the rollgap (h), means for deriving from the first, second, third and fourth input signals a first output signal indicative of total roll eccentricity, means for coupling the means for producing the first, second, third and fourth input signals to the means for deriving from the first, second, third and fourth input signals an output signal, means for deriving a signal indicative of instantaneous product thickness at the rollgap, means for compensating the signal indicative of instantaneous product thickness for the total roll eccentricities indicated by the first output signal, means for coupling the means for deriving a signal indicative of instantaneous product thickness at the rollgap to the means for compensating the signal indicative of instantaneous product thickness for the total roll eccentricities indicated by the first output signal, and means for coupling the means for deriving from the first, second, third and fourth input signals a first output signal indicative of total roll eccentricity to the means for compensating the signal indicative of instantaneous product thickness for the total roll eccentricities indicated by the first output signal.

13. Apparatus according to claim 12 further comprising means for controlling the gap between the work rolls in accordance with the compensated signal, and means for coupling the means for controlling the gap between the work rolls in accordance with the compensated signal to the means for compensating the signal indicative of instantaneous product thickness for the total roll eccentricities indicated by the first output signal.

14. Apparatus according to claim 12 further comprising means for deriving a signal indicative of instantaneous product thickness from the first input signal and the second input signal, means for coupling the means for deriving a signal indicative of instantaneous product thickness from the first input signal and the second input signal to the means for producing a first input signal and to the means for producing a second input signal, and means for coupling the means for deriving a signal indicative of instantaneous product thickness from the first input signal and the second input signal to the means for compensating the signal indicative of instantaneous product thickness for the total roll eccentricities indicated by the first output signal.

15. Apparatus for controlling the thickness of material produced by a rolling mill stand comprising means for producing a first input signal indicative of the roll force (F′), means for producing a second input signal indicative of rollgap position (S), means for producing a third input signal indicative of roll angular position, means for producing a fourth input signal indicative of product thickness at a predetermined downstream position relative to the rollgap (h), means for deriving from the first, second, third and fourth input signals a first output signal indicative of total roll eccentricities, means for coupling the means for producing the first, second, third and fourth input signals to the means for deriving from the first, second, third and fourth input signals a first output signal indicative of total roll eccentricities, means for filtering the first output signal to minimize the influence of noise and produce a second output signal representing the predicted, composite roll eccentricity at the rollgap for all rolls whose periods are specified by angular position or speed measurements or roll diameter information, means for coupling the means for deriving from the first, second, third and fourth input signals a first output signal indicative of total roll eccentricities to the means for filtering the first output signal, means for deriving from the first input signal and second input signal a third output signal indicative of instantaneous product thickness at the rollgap, means for coupling the means for producing a first input signal and the means for producing a second input signal to the means for deriving from the first input signal and second input signal a third output signal indicative of instantaneous product thickness at the rollgap, means for utilizing the second output signal and third output signal to adjust the rollgap position whereby to control thickness independently of roll eccentricity disturbances, and means for coupling the means for filtering the first output signal to minimize the influence of noise and produce a second output signal and the means for deriving from the first input signal and second input signal a third output signal indicative of instantaneous product thickness at the rollgap to the means for utilizing the second output signal and third output signal to adjust the rollgap position.

16. Apparatus according to claim 15 wherein the means for coupling the means for deriving from the first input signal and second input signal a third output signal indicative of instantaneous product thickness at the rollgap to the means for utilizing the second output signal and third output signal to adjust the rollgap position comprises means for introducing a deadzone to reduce the effect of unfiltered error components in the instantaneous thickness estimate.

17. A rolling mill comprising means for producing a first input signal indicative of total roll force, means for producing a second input signal indicative of rollgap position, means for producing a third signal indicative of the angular position of a first mill roll, means for producing a fourth input signal indicative of product thickness at a predetermined downstream location relative to the rollgap, and means for deriving from said first, second, third and fourth input signals a first output signal indicative of the total roll eccentricity affecting the true instantaneous rollgap position as a function of the first mill roll angular position, and means for coupling the first input signal producing means, the second input signal producing means, the third input signal producing means and the fourth input signal producing means to the means for deriving from said first, second, third and fourth input signals a first output signal.

18. A rolling mill comprising apparatus for controlling the thickness of material produced thereby, said apparatus including means for producing a first input signal indicative of roll force (F'), means for producing a second input signal indicative of rollgap position (S), means for producing a third input signal indicative of roll angular position, means for producing a fourth input signal indicative of product thickness at a predetermined position downstream relative to the rollgap (h), means for deriving from the first, second, third and fourth input signals a first output signal indicative of total roll eccentricity, means for deriving a signal indicative of instantaneous product thickness at the rollgap, means for compensating the signal indicative of instantaneous product thickness for the total roll eccentricities indicated by the first output signal, means for coupling the first input signal producing means, the second input signal producing means, the third input signal producing means and the fourth input signal producing means to the means for deriving from the first, second, third and fourth input signals a first output signal, means for coupling the means for deriving a signal indicative of instantaneous product thickness at the rollgap to the means for compensating the signal indicative of instantaneous product thickness, and means for coupling the means for deriving from the first, second, third and fourth input signals of first output signal to the means for compensating the signal indicative of instantaneous product thickness.

* * * * *